US005762011A

United States Patent [19]

Murakami

[11] Patent Number: 5,762,011

[45] Date of Patent: Jun. 9, 1998

[54] EMBROIDERING SEWING MACHINE

[75] Inventor: Eiji Murakami, Hachioji, Japan

[73] Assignee: Janome Sewing Machine Co., Ltd., Tokyo, Japan

[21] Appl. No.: 831,783

[22] Filed: Apr. 9, 1997

[30] Foreign Application Priority Data

May 8, 1996 [JP] Japan ..... 8-137441
Jun. 10, 1996 [JP] Japan ..... 8-168726

[51] Int. Cl.[6] ..... D05B 21/00; D05C 5/04

[52] U.S. Cl. ..... 112/102.5

[58] Field of Search ..... 112/102.5, 470.06, 112/220, 221, 277

[56] References Cited

U.S. PATENT DOCUMENTS 4,108,093 8/1978 Watanabe et al. ..... 112/220 X
4,391,211 7/1983 Yamamoto et al. ..... 112/470.06
4,883,008 11/1989 Hiramatsu ..... 112/277 X

*Primary Examiner*—Peter Nerbun
*Attorney, Agent, or Firm*—Nields, Lemack & Dingman

[57] ABSTRACT

An embroidering sewing machine which is electronically controlled is described, wherein a plurality of addresses of stitch data for controlling the stitching operation are divided into a plurality of blocks each of which comprises N number of stitch data each of which is successively elected as the initial stitch data of each block and provides a distance between the adjacent stitches. The speed of the vertical movement of the machine needle is decided by setting a specific rate of speed corresponding to the maximum rate of distance of each block. The number N may be optionally selected to avoid the abrupt change of speed which may otherwise occur depending upon the embroidery patterns to be stitched.

13 Claims, 8 Drawing Sheets

| ADDRESS | | STITCH DATA △X | STITCH DATA △Y | | SET SPEED | SET SPEED |
|---|---|---|---|---|---|---|
| | 0 | INITIAL VALUE | INITIAL VALUE | (SPEED) | N=3 | N=5 |
| | 1 | 2 | 2 | 500 | 300 | 200 |
| ① | 2 | 3 | 2 | 400 | 200 | 200 |
| ② | 3 | 4 | 2 | 300 | 200 | 200 |
| ③ | 4 | 5 | 2.5 | 200 | 200 | 200 |
| | 5 | 3 | 2 | 400 | 400 | 100 |
| | 6 | 3 | 2 | 400 | 400 | 100 |
| | 7 | 2 | 2 | 500 | 100 | 100 |
| | 8 | 2 | 2 | 500 | 100 | 100 |
| | 9 | 6 | 2 | 100 | 100 | 100 |
| | 10 | 4 | 2.5 | 300 | 300 | 300 |
| | 11 | 2 | 2 | 500 | 400 | 200 |
| | 12 | 3 | 2 | 400 | 400 | 200 |
| | 13 | 2 | 2 | 500 | 200 | 200 |
| | 14 | 3 | 2 | 400 | 200 | 200 |
| | 15 | 5 | 2.5 | 200 | 200 | 200 |
| | 16 | 5 | 2 | 200 | 200 | 200 |
| | 17 | 2 | 2 | 500 | 500 | 300 |
| | 18 | 2 | 2 | 500 | 500 | 300 |
| | 19 | 2 | 2 | 500 | 300 | 300 |
| | 20 | 1 | 2 | 500 | 300 | 200 |
| | 21 | 4 | 2 | 300 | 300 | 200 |
| | 22 | 2 | 2 | 500 | 200 | 200 |
| | 23 | 3 | 3 | 400 | 200 | 200 |
| | 24 | 5 | 2 | 200 | 200 | 200 |
| | 25 | 2 | 2 | 500 | 500 | 400 |
| | 26 | 1 | 2 | 500 | 500 | 300 |
| | 27 | 1 | 2 | 500 | 400 | 100 |
| | 28 | 2 | 2 | 500 | 300 | 100 |
| | 29 | 3 | 2 | 400 | 100 | 100 |
| | 30 | 4 | 2 | 300 | 100 | 100 |

| | STITCH DATA | | | SET SPEED | SET SPEED |
|---|---|---|---|---|---|
| | △X | △Y | | | |
| 0 | INITIAL VALUE | INITIAL VALUE | (SPEED) | N=3 | N=5 |
| 1 | 2 | 2 | 500 | 300 | 200 |
| 2 | 3 | 2 | 400 | 200 | 200 |
| 3 | 4 | 2 | 300 | 200 | 200 |
| 4 | 5 | 2.5 | 200 | 200 | 200 |
| 5 | 3 | 2 | 400 | 400 | 100 |
| 6 | 3 | 2 | 400 | 400 | 100 |
| 7 | 2 | 2 | 500 | 100 | 100 |
| 8 | 2 | 2 | 500 | 100 | 100 |
| 9 | 6 | 2 | 100 | 100 | 100 |
| 10 | 4 | 2.5 | 300 | 300 | 300 |
| 11 | 2 | 2 | 500 | 400 | 200 |
| 12 | 3 | 2 | 400 | 400 | 200 |
| 13 | 2 | 2 | 500 | 200 | 200 |
| 14 | 3 | 2 | 400 | 200 | 200 |
| 15 | 5 | 2.5 | 200 | 200 | 200 |
| 16 | 5 | 2 | 200 | 200 | 200 |
| 17 | 2 | 2 | 500 | 500 | 300 |
| 18 | 2 | 2 | 500 | 500 | 300 |
| 19 | 2 | 2 | 500 | 300 | 300 |
| 20 | 1 | 2 | 500 | 300 | 200 |
| 21 | 4 | 2 | 300 | 300 | 200 |
| 22 | 2 | 2 | 500 | 200 | 200 |
| 23 | 3 | 3 | 400 | 200 | 200 |
| 24 | 5 | 2 | 200 | 200 | 200 |
| 25 | 2 | 2 | 500 | 500 | 400 |
| 26 | 1 | 2 | 500 | 500 | 300 |
| 27 | 1 | 2 | 500 | 400 | 100 |
| 28 | 2 | 2 | 500 | 300 | 100 |
| 29 | 3 | 2 | 400 | 100 | 100 |
| 30 | 4 | 2 | 300 | 100 | 100 |

| DISTANCE | SPEED (RPM) |
|---|---|
| 1 | 500 |
| 1.5 | 500 |
| 2 | 500 |
| 2.5 | 450 |
| 3 | 400 |
| 3.5 | 350 |
| 4 | 300 |
| 4.5 | 250 |
| 5 | 200 |
| 5.5 | 150 |
| 6 | 100 |
| 6.5 | 100 |
| 7– | MINIMUM RATE OF SPEED |

FIG. 4

| | STITCH DATA | | | MINIMUM RATE OF SPEED | | |
|---|---|---|---|---|---|---|
| | △X | △Y | | | AMENDED RATE OF SPEED | |
| 0 | INITIAL VALUE | INITIAL VALUE | (SPEED) | N=3 | +α = 4 0 | +α = 7 0 |
| 1 | 2 | 2 | 500 | 300 | 40 | 70 |
| 2 | 3 | 2 | 400 | 200 | 80 | 140 |
| 3 | 4 | 2 | 300 | 200 | 120 | 200 |
| 4 | 5 | 2.5 | 200 | 200 | 160 | 200 |
| 5 | 3 | 2 | 400 | 400 | 200 | 270 |
| 6 | 3 | 2 | 400 | 400 | 240 | 340 |
| 7 | 2 | 2 | 500 | 100 | 100 | 100 |
| 8 | 2 | 2 | 500 | 100 | 100 | 100 |
| 9 | 6 | 2 | 100 | 100 | 100 | 100 |
| 10 | 4 | 2.5 | 300 | 300 | 140 | 170 |
| 11 | 2 | 2 | 500 | 400 | 180 | 240 |
| 12 | 3 | 2 | 400 | 400 | 220 | 310 |
| 13 | 2 | 2 | 500 | 200 | 200 | 200 |
| 14 | 3 | 2 | 400 | 200 | 200 | 200 |
| 15 | 5 | 2.5 | 200 | 200 | 200 | 200 |
| 16 | 5 | 2 | 200 | 200 | 200 | 200 |
| 17 | 2 | 2 | 500 | 500 | 240 | 270 |
| 18 | 2 | 2 | 500 | 500 | 280 | 340 |
| 19 | 2 | 2 | 500 | 300 | 300 | 300 |
| 20 | 1 | 2 | 500 | 300 | 300 | 300 |
| 21 | 4 | 2 | 300 | 300 | 300 | 300 |
| 22 | 2 | 2 | 500 | 200 | 200 | 200 |
| 23 | 3 | 3 | 400 | 200 | 200 | 200 |
| 24 | 5 | 2 | 200 | 200 | 200 | 200 |
| 25 | 2 | 2 | 500 | 500 | 240 | 270 |
| 26 | 1 | 2 | 500 | 500 | 280 | 340 |
| 27 | 1 | 2 | 500 | 400 | 320 | 400 |
| 28 | 2 | 2 | 500 | 300 | 300 | 300 |
| 29 | 3 | 2 | 400 | 100 | 100 | 100 |
| 30 | 4 | 2 | 300 | 100 | 100 | 100 |

FIG. 7

EMBROIDERING SEWING MACHINE

FIELD OF THE INVENTION AND RELATED ART STATEMENT

The present invention relates to an embroidering sewing machine and more particularly to stitching embroidery patterns at high speed and with a stabilized condition.

The embroidery stitching by use of a sewing machine is generally performed by moving in the X-Y directions the embroidery frame relative to the machine needle, which has a cloth extended thereon to be stitched.

It is therefore required that the embroidery frame is moved while the machine needle is located above the cloth irrespectively of the distance in which the embroidery frame is moved. The driving speed, that is, the stitching speed of the sewing machine is therefore so set as to allow the embroidery frame to traverse a maximum distance while the vertically reciprocating machine needle is above the cloth.

With the way of setting speed as mentioned above, the stitching speed remains slow if the distance is short, in which the embroidery frame traverses, and it will take a long time to stitch up the embroidery pattern. Therefore it has been proposed that the stitch data are divided into a plurality of blocks N in consideration of the sequential movements and the rates of moving the distance of the embroidery frame, and each of the data blocks is given a specific rate of stitching speed, thereby to provide a plurality of speed blocks for controlling the stitching speed of the sewing machine. In this case, however, if there is one stitch which requires the embroidery frame to move a long distance, all the speed blocks are influenced by the stitch and must effect speed control on the basis of the long distance, resulting in failure of high speed stitching control of the sewing machine.

Further it has been proposed that each of the stitches is set with a specific speed in dependence on the moving rates of the embroidery frame, so that the speed control may be made to each of the vertical reciprocating movements of the needle in accordance with each rate of the distance in which the embroidery frame traverses.

However in this case, if the moving distance of the embroidery frame varies with high frequency, the machine needle is required to vertically reciprocate at the different rates of speed with the frequency of the change of distance accordingly. This will give rise to a problem that the actuator including the machine motor for driving the machine needle will not be able to positively follow up the speed change.

In particular the common machine motor can not be abruptly switched from high speed to low speed. In order to make the machine motor positively follow up such abrupt speed change, it is required that the machine motor is provided with a braking mechanism which is considerably costly.

Further the repetition of abrupt acceleration and deceleration will give a heavy burden to the machine drive mechanism and will reduce the endurance of the mechanism.

SUMMARY OF THE INVENTION

The present invention has been provided to eliminate the defects and the disadvantages of the prior art. According to the invention, the embroidery stitching is performed to a cloth extended on an embroidery frame which is moved relative to the machine needle in the X-Y directions. The stitch data comprise the data for deciding the relative positions between the machine needle and the embroidery frame. The stitch data are divided into a plurality of blocks in the order of stitches to be formed. Each of the stitch blocks comprises N series of stitch data with each of the subsequent stitch data being elected as the initial stitch data. Each of the stitch data blocks is designated with a specific minimum rate of speed which is then set as the vertically reciprocating speed of the machine needle.

The minimum rate of speed designated to each of the data blocks may be amended. Precisely the minimum rate of speed Vm is compared with the set speed Vs of the immediately preceded data of the block. If Vm is higher than Vs by a predetermined value, the speed may be recognized to be abruptly accelerated. In this case, Vm is amended to obtain a minimum speed Vm to avoid the abrupt acceleration. This amendment may be implemented, for example, by subtracting a predetermined value from Vm or by adding a predetermined value to Vs. On the contrary, if Vm is not higher than Vs by a predetermined value, the minimum rate of speed Vm is amended to be set as Vs.

It is desirable that the minimum rate of speed is determined in consideration of the distance in which the embroidery frame is required to traverse between two stitches. Further it is desirable that the blocked N number of stitch data may be optionally set by the user.

BRIEF DESCRIPTION OF THE DRAWINGS

FIG. 4 is a table showing the relations between distances and speeds according to the invention;

FIG. 7 is a table showing a data structure as a second embodiment of the invention.

DETAILED DESCRIPTION OF THE PREFERRED EMBODIMENTS

The invention will now be described in reference to the preferred embodiments as shown in the attached drawings.

Figure 2:
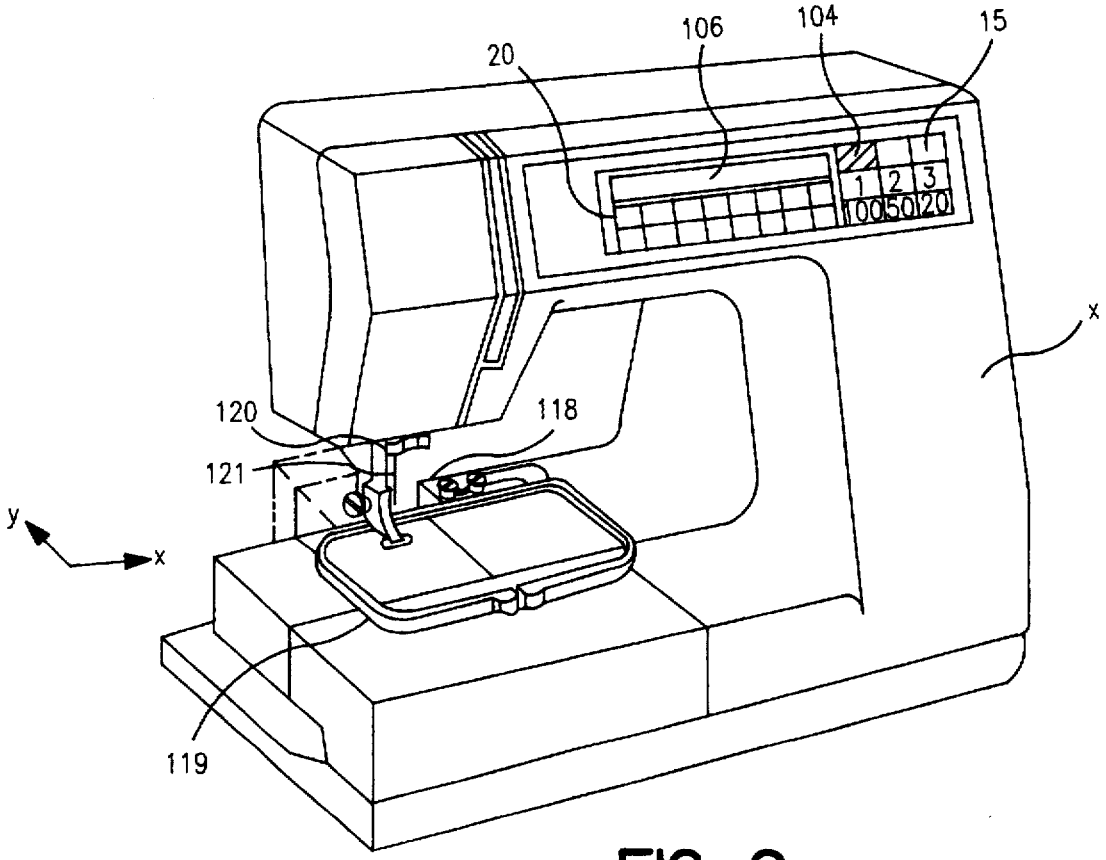
FIG. 2 is a perspective view of a sewing machine having the invention provided therewith.

In reference to FIG. 2, the sewing machine X of the invention has a needle 121 which is secured to the lower end of a needle bar 120 which is vertically reciprocated as a part of a stitch forming mechanism 112 which will be mentioned hereinlater and further has a carriage 118 which is a part of an X-Y drive mechanism 117 which will be mentioned hereinlater and carries an embroidery frame 119 thereon.

The embroidery frame 119 has a cloth extended thereon to be stitched with relative movements of the carriage 118 in the X-Y directions and of the needle bar 120 and the needle 121 which are reciprocated in the vertical directions. This embroidery stitching may be selected by manual operation of a stitch mode selecting button 104. At the time of normal mode stitching, the cloth is stitched with the vertically reciprocating needle 121 and the cloth feeding mechanism (not shown) for feeding the cloth relative to the needle thereunder.

Figure 1:
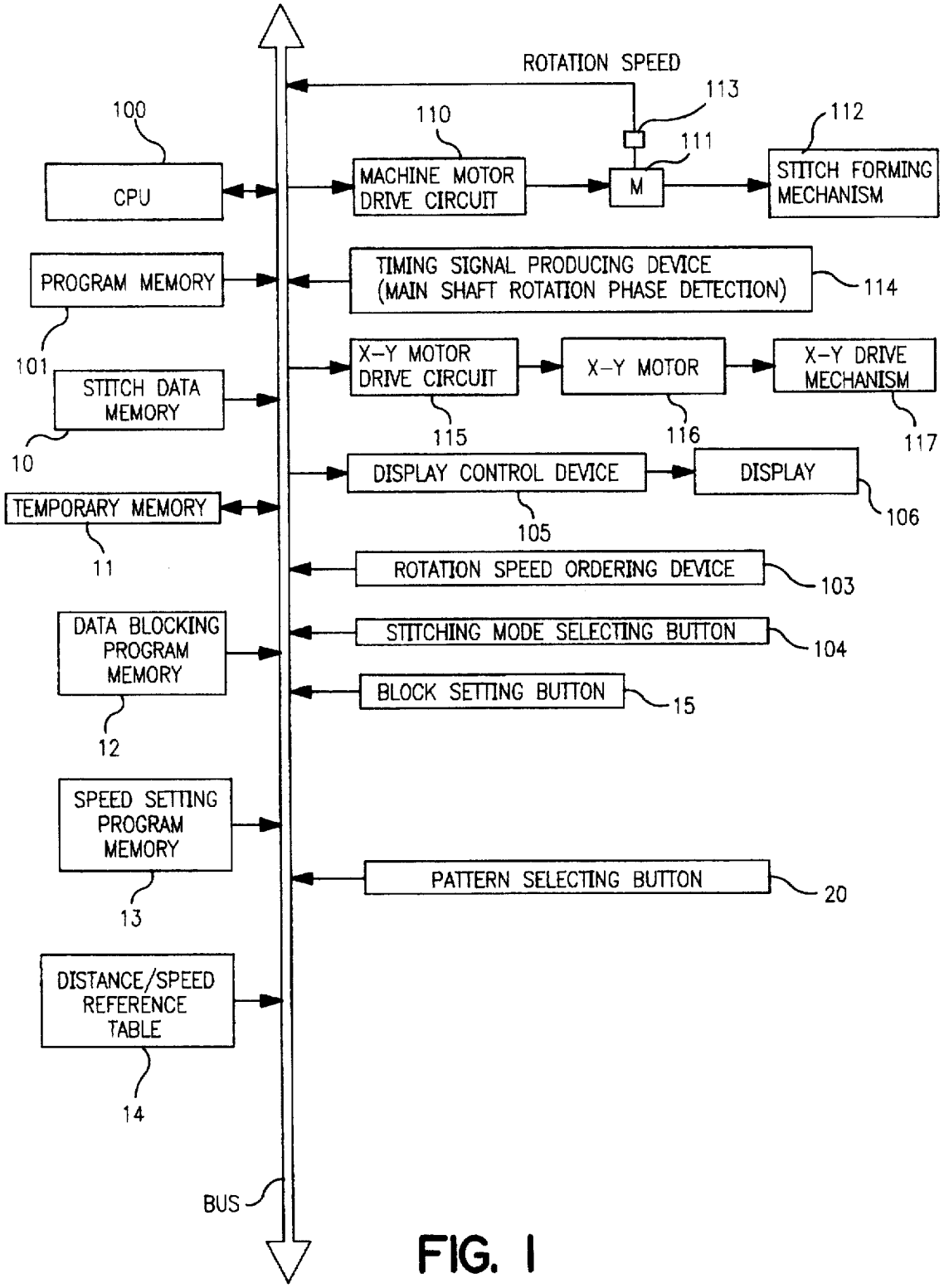
FIG. 1 is a block diagram showing an embodiment of substantial structure according to the invention.

Now in reference to FIG. 1 showing a substantial structure of the invention in a block diagram and further to FIG. 2, CPU 100 is operated to control the operations of the sewing machine in accordance with the programs stored in a program memory 101. At the time of normal stitching, the CPU 100 is responsive to the orders from a rotation speed ordering device 103 such as a foot operated controller, thereby to control a motor drive circuit 110 so as to rotate a machine motor 111 at an ordered speed, thus to drive the stitch forming mechanism 112 at the ordered speed. On the other hand, at the time of embroidery stitching, the CPU 100 is operated in accordance with the programs stored in a speed setting program memory 13, thereby to operate the X-Y drive mechanism 117 at a speed set by the speed setting programs.

As shown in FIG. 2, the stitch forming mechanism 112 includes the needle bar 120, the needle 121 and the cloth feeding mechanism (not shown) and performs the normal stitching for formation of the various utility stitches including various pattern stitches other than the embroidery stitches. The rotation number of the machine motor 111 is detected by a motor rotation sensor 113 and is feedbacked to the CPU 100 so as to be used for controlling the rotation speed of the machine motor 111.

The embroidering sewing machine has an X-Y motor drive circuit 115 and an X-Y motor 116 in addition to the aforementioned machine motor drive circuit 110 and X-Y drive mechanism 117, and is operated under the control of the stitch data stored in a stitch data memory 10 to perform embroidery stitching. The X-Y drive mechanism 117 includes the carriage 118 and the embroidery frame 119 as shown in FIG. 2 and is operated to move the embroidery frame 119 through the carriage 118 in the X-Y directions relative to the machine needle 121, so that the cloth held by the embroidery frame may be stitched.

A timing signal producing device 114 is operated in cooperation with a main rotation shaft of the sewing machine and detects the rotation phases of the main rotation shaft, thereby to detect the upper and lower positions of the machine needle 121 and produce the corresponding timing signals. The CPU 100 is responsive to the timing signals from the timing signal producing device 114 to control the X-Y motor drive circuit 115, thereby to operate the X-Y drive mechanism 115 through the X-Y motor 116 in timed relation with the machine needle 121.

The above mentioned normal stitching and embroidery stitching are optionally selected by manual operation of the stitch mode selecting button 104 which is provided on the sewing machine X as shown in FIG. 2.

Further the sewing machine X has a display 106 provided thereon for indicating various information thereon under the control of a display control device 105 which is operated by the orders from the CPU 100. The sewing machine further has a temporary memory 11 incorporated therein.

The CPU 100 has further connected thereto a data blocking program memory 12, a speed setting program memory 13, a distance/speed reference table 14 and a block setting button 15.

Figure 3:
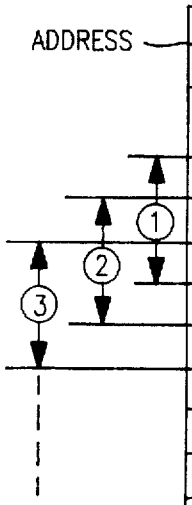
FIG. 3 is a table showing a data structure as a first embodiment of the invention.

FIG. 3 shows one example of the stitch data structure stored in the stitch data memory 10. In this example, there are addresses from 0 to 30 (stitching order), each of which has x-y relative coordinates Δx and Δy so set thereto representing a rate of distance in which the embroidery frame 119 is required to traverse.

The distance/speed reference table 14 has set therein the rates of distance and the corresponding rates of speed as shown in FIG. 4.

Each of the addresses further has a speed set corresponding to the relative coordinates (distance). This speed is set in correspondence to the greater one of the coordinates Δx and Δy and in compliance with the speed as specified in the distance/speed reference table 14. For example, since the address 2 has the moving amount 3 in the x direction and the moving amount 2 in the y direction, the speed 400 is set in correspondence to the moving amount 3.

The data blocking program memory 12 has data blocking programs stored therein. The CPU 100 is operated in accordance with the data blocking programs to block the stitch data stored in the stitch data memory 10. This data blocking may be performed prior to the stitching operation or in the process of the stitching operation.

The stitch data are blocked with each of which being successively elected as the initial data (initial address). Each block comprises N series of stitch data as shown in FIG. 3. For example, if N=3, the addresses 1 to 3 belong to block ①, the addresses 2 to 4 belong to block ② the addresses 3 to 5 belong to block ③. . . . In this way, the stitch data are blocked.

Then a minimum rate of speed is decided in each block in accordance with the programs stored in the speed setting program memory 13. The minimum rate of speed is set as the speed of the initial address of the block.

In case of the block ①, the rates of speed of the addresses are 500, 400 and 300 respectively, and the minimum rate of speed is 300. Therefore the speed of the initial address 1 is set to 300.

In case of the block ②, the rates of speed of the addresses are 400, 300 and 200 respectively, and the minimum rate of speed is 200. Therefore the speed of the initial address is set to 200. In the same way, the following blocks are designated with the minimum rates of speed respectively.

The addresses 29 and 30 have no stitch data to be followed, that is, no N=3 data to be followed. In this case, the minimum rate of speed 100 of FIG. 4 is set to these addresses.

In case of N=5, the same procedure is employed to set a minimum rate of speed to each block.

Figure 5:
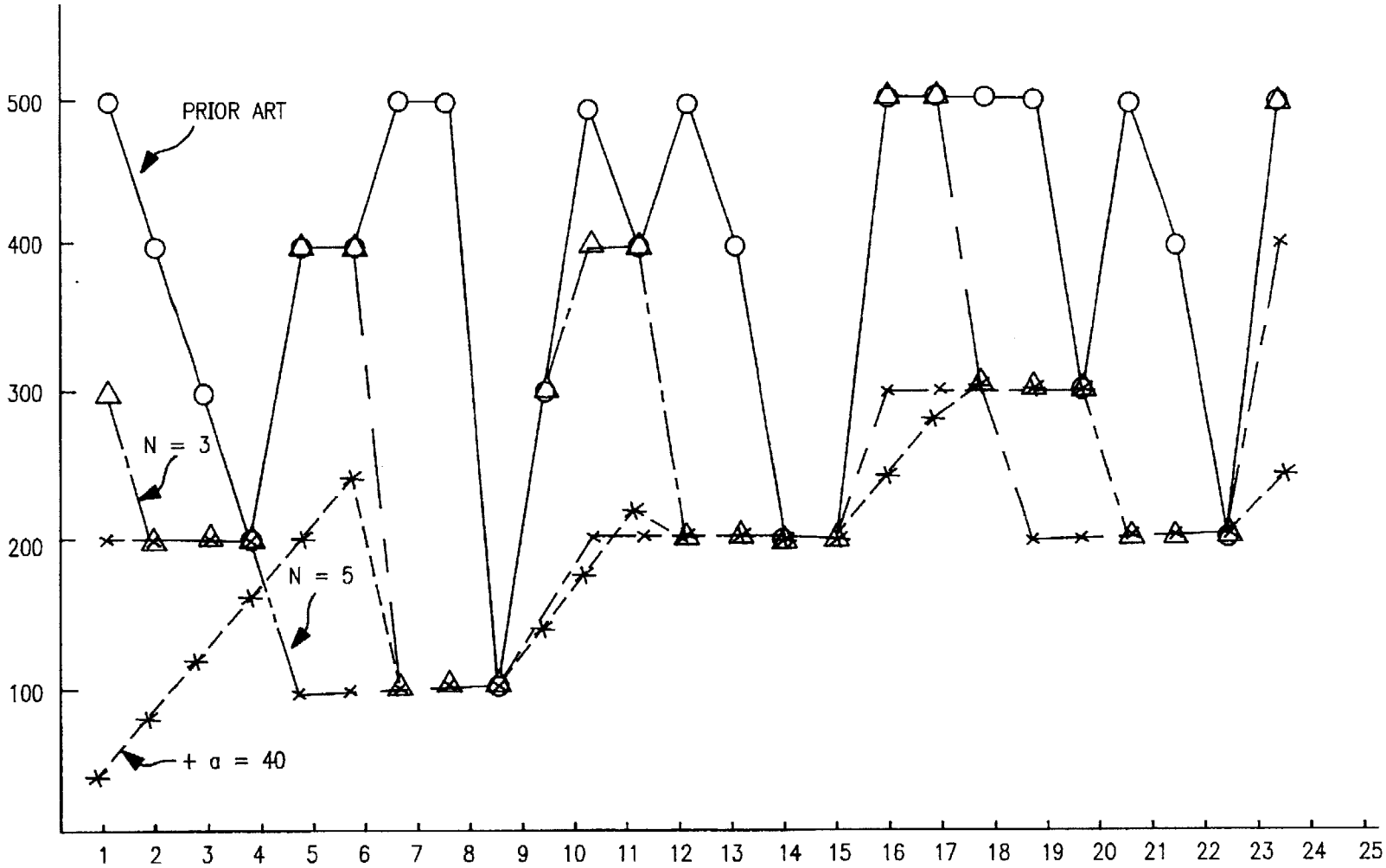
FIG. 5 is a graphic representation of the relations between the original rates of speed and the set rates of speeds as shown in FIGS. 3 and 7.

FIG. 5 shows the set rates of speed of the data blocks plotted in comparison with the original rates of speed (conventional rates of speed), wherein the marks ○ show the rates of speed of the conventional art, the marks Δ show the set rates of speed in case the blocked stitch data are N=3, and the marks x show the set rates of speed in case that the blocked stitch data are N=5.

As is apparent from the graphs as shown in FIG. 5, the new set rates of speed show few abrupt changes of speed, and the speed change is milder while the speed is slower the increase of N.

According to this embodiment, since the sewing machine is provided with the block setting button 15, the user may optionally set the number N of stitch data to select a high speed stitching operation or a slow and smooth stitching operation.

Figure 6:
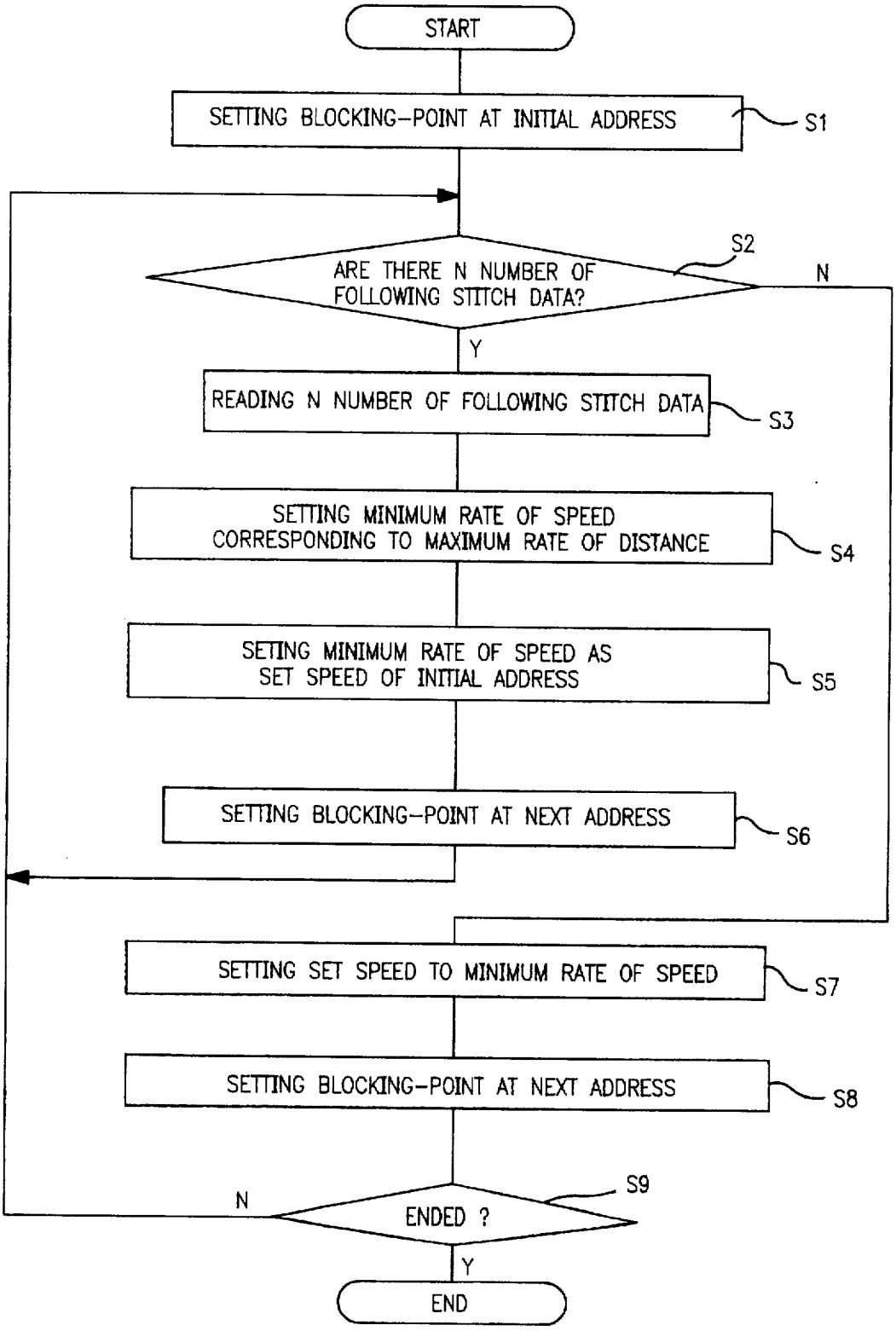
FIG. 6 is a first flow chart showing the operations of the embodiment according to the invention.

FIG. 6 shows a flow chart for explaining the operations of blocking the stitch data and setting the rates of speed.

At first, the operation is as follows: setting a point at one address from which the block is formed (step S1), confirming if there are following N number of stitch data (step S2), if there are so many stitch data, reading out the N number of stitch data (step S3), deciding a minimum rate of speed in place of the speed of a maximum rate of distance of the following N number of stitch data (step 4), and setting the minimum rate of speed as the speed of the initial address (step S5), and setting the point at following another one address (step S6), and then the routine is returned to step S2.

In case there are no following N number of stitch data from the pointed address at step S2, the operation is as follows: setting the minimum rate of speed of FIG. 4 as the speed of the pointed address (step S7), setting the point the next address (step S8) and confirming if the data blocking operation is finished or not (step S9). If the operation is not finished, the routine is returned to step S2.

However there may often remain abrupt acceleration of speed even in the blocks of stitch data as mentioned above. This problem may be solved by amending the minimum rate of speed Vm. For example, as shown in FIG. 7, the minimum rate of speed Vm in the data block which is N=3 is compared with the set speed Vs of the immediately preceded stitch data. If the speed difference is more than a predetermined value k, Vm is amended. According to the embodiment, the set speed Vs is added by a predetermined value "a", that is, V'm=Vs+a. The amended V'm is set as the minimum rate of speed V's of the stitch data block. Alternatively, various ways of amendment may be employed. For example, Vm is subtracted by a predetermined value, or Vs and Vm are multiplied by a predetermined value.

On the basis of the minimum rate of speed obtained from the data block N=3 in FIG. 7, the predetermined values may be set such as k=80, a=40 and a=70 to actually amend the set minimum rate of speed.

For example, at the address 1, since the speed acceleration is from 0 to 300, it becomes Vm−Vs>k(=80) which is the object for amendment. Then the calculation Vs+a=0+40 is performed, and thus the amended rate of speed 40 is obtained. This amended rate of speed is newly set to control the machine motor drive circuit 110. The graph shown with the marks ·X· and dotted line in FIG. 5 represents the amended rate of speed of the sewing machine, that is, of the vertical reciprocating movement of the machine needle, wherein the abrupt acceleration of speed is moderated.

Figure 8:
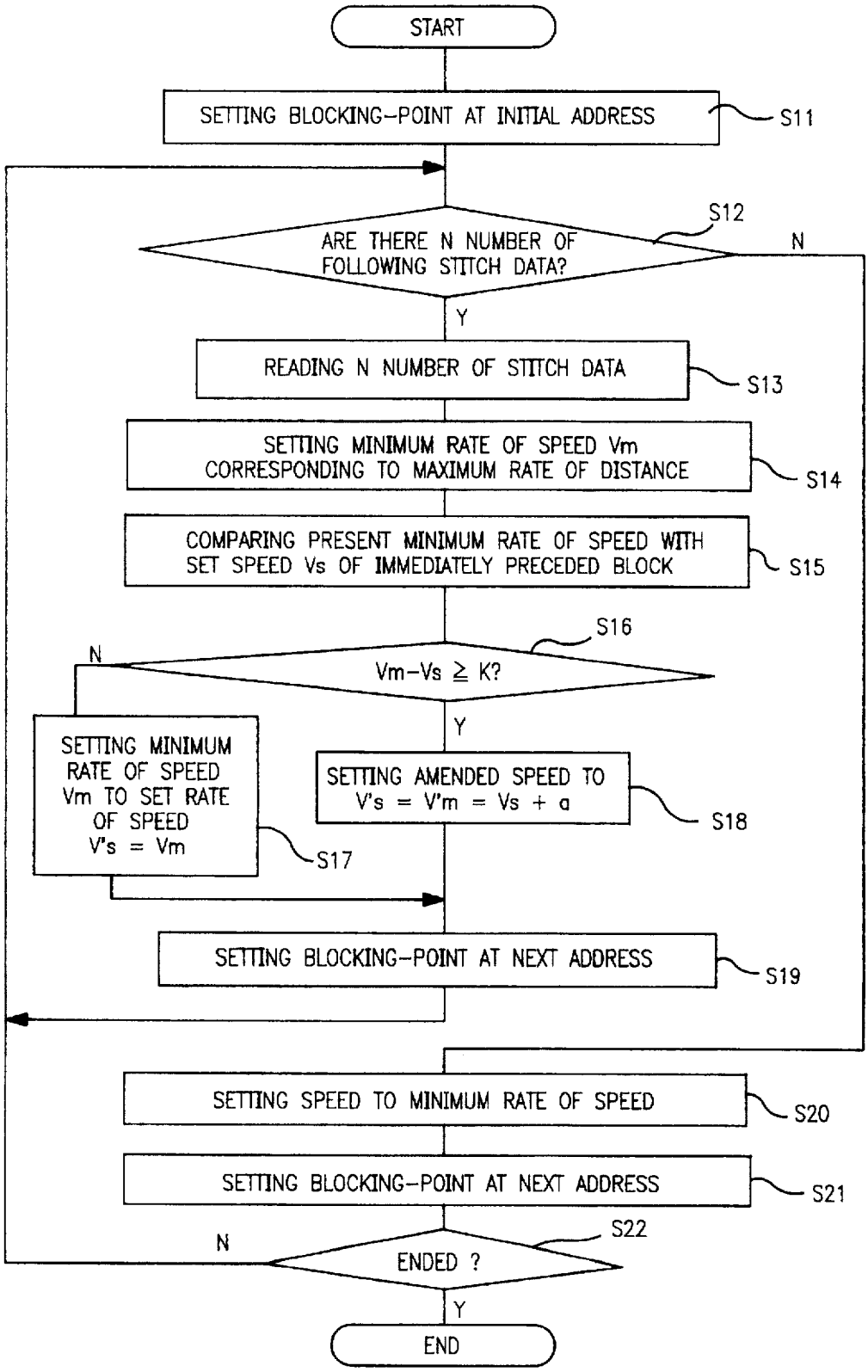
FIG. 8 is a second flow chart showing the operations of the embodiment according to the invention.

FIG. 8 shows the operations for amendment of the set minimum rate of speed.

At first, the operation is as follows: setting the point at one address from which the stitch data block is formed (step S11), confirming if there are N number of following stitch data or not (step S12). If there are so many stitch data, the operation continues as follows reading out the N number of stitch data (step S13), deciding the speed of the maximum rate of distance of the stitch data block as the minimum rate of speed Vm (step S14). These operations are the same as those of FIG. 6. Then the minimum rate of speed Vm with the set speed Vs of the immediately preceded stitch data (step S15) is compared, it is determined if Vs−Vm≧k or not (step S16). If Vs−Vm is less than k, the minimum rate of speed Vm as the speed of the initial stitch data of the block (step S17) is set. On the contrary, if Vs−Vm is more the k, a predetermined value "a" is added to the set speed Vs of the immediately preceded stitch data, thereby to set the calculated rate of speed as the speed of the block (step S18). Then the point at another one address from which another block is to be formed (step S19 is newly set), and the routine is returned to the step S12.

In case there are no following N number of stitch data from the step S12, the operation is as follows: setting there the minimum rate of speed of FIG. 4 (step S20), and setting the point at the next address (step S21), and then confirming if the operation is finished or not (step S22). If the operation is not finished, the routine is returned to the step S12.

In the above mentioned embodiment, though amendment is not performed when the deceleration is more than a predetermined value, such deceleration may be amended by Vs−a when Vs−Vm≧k. However in case of deceleration, it is required that the deceleration will always reach the minimum rate of speed Vm, and this is desired to be achieved in each block. Namely if N=3, the set speed must reach Vm at the third stitch without fail. This may be realized by providing a brake.

As mentioned above, according to the embodiments of the invention, instead of deciding the vertical reciprocating speed of the needle per stitch data, each of the stitch data in series is elected as the initial stitch data in each of the blocks including a predetermined number of stitch data, and a maximum rate of speed represented by one of the stitch data in each block is set as the speed for the stitch data constituting the block. Thus the abrupt change of stitching speed of the machine needle may be moderated. This may enable the vertical reciprocating mechanism of machine needle by use of a common machine motor to positively follow the change of speed due to the different rates of distance in which the embroidery frame is required to traverse.

Further an operating button may be provided so as to enable the user to optionally select the number of stitch data for forming each of the stitch data block, that is, to optionally select the speed control of the machine needle. Thus the invention will realize a high speed and steady stitching operation without the risk of abrupt change of movements of the machine needle.

The entire disclosures of Japanese Patent Applications No.8-137441 filed on May 8, 1996 and No.8-168726 filed on Jun. 10, 1996 including specifications, claims, drawings and summaries are incorporated herein by reference in its entirety.

What is claimed is:

1. An embroidering sewing machine having means for vertically reciprocating a needle and means for moving an object to be stitched relative to said needle thereby to form stitches on said object, said sewing machine comprising:

a) memory means having stitch data stored therein for deciding the positions of said object relative said needle in accordance of an embroidery pattern to be stitched;

b) a first means for vertically reciprocating said needle at a specified speed;

c) a second means for defining a plurality of blocks each of which comprises N number of stitch data arranged in the order of the stitches formed by said stitch data with each stitch data being successively elected as an initial data in each block;

d) a third means for deciding a minimum rate of speed from said N number of stitch data in each block and setting said minimum rate of speed as the speed of the vertical reciprocating movement of said needle which is caused in correspondence to said initial stitch data; and e) a fourth means for vertically reciprocating said needle on the basis of said set speed.

2. The embroidering sewing machine as defined in claim 1, wherein said third means is operated to decide said minimum rate of speed on the basis of the lengths of the respective stitches formed by said stitch data.

3. The embroidering sewing machine as defined in claim 2, further comprising a table specifying the rates of speed of the vertical reciprocating movement of said needle in correspondence to the lengths of the respective stitches formed by said stitch data in each of said blocks, and wherein said third means is operated to decide said minimum rate of speed on the basis of said table.

4. The embroidering sewing machine as defined in claim 2, wherein said third means is operated to decide a lower minimum rate of speed when a distance between the stitches is relatively greater.

5. The embroidering sewing machine as defined in claim 3, wherein said third means is operated to set a minimum rate of speed specified in said table with respect to an initial stitch data having no N number of following stitch data.

6. The embroidering sewing machine as defined in claim 1, further comprising means for setting N number of stitch data in each of said blocks.

7. An embroidering sewing machine having means for vertically reciprocating a needle and means for moving an object to be stitched relative to said needle thereby to form stitches on said object, said sewing machine comprising:

a) memory means having stitch data stored therein for deciding the positions of said object relative to said needle in accordance with an embroidery pattern to be stitched;

b) a first means for vertically reciprocating said needle at a specified speed;

c) a second means for defining a plurality of blocks each of which comprises N number of stitch data arranged in the order of the stitches formed by said stitch data with each stitch data being successively elected as an initial data in each block;

d) a third means for deciding a minimum rate of speed from said N number of stitch data and setting said minimum rate of speed as the speed of the vertical reciprocating movement of said needle;

e) a fourth means for comparing the present minimum rate of speed with the minimum rate of speed which has been set at the immediately preceding stitch data and discriminating if there is a difference with respect to time between said two rates of speed, said fourth means being operated to amend said present minimum rate of speed into an amended minimum rate of speed and set the same as the speed of the vertical reciprocating movement of said needle which is caused in correspondence to said initial stitch data if the difference is more than a predetermined value, said fourth means being operated to set said present minimum rate of speed as the speed of the vertical reciprocating movement of said needle which is caused in correspondence to said initial stitch data if the difference is not more than the predetermined value with respect to time; and f) a fifth means for vertically reciprocating said needle at said set rate of speed.

8. The embroidering sewing machine as defined in claim 7, wherein said third means is operated to decide said minimum rate of speed on the basis of the distance between the stitches formed by said stitch data.

9. The embroidering sewing machine as defined in claim 8, further comprising a table specifying the rates of speed of the vertical reciprocating movement of said needle in correspondence to the rates of distance between the stitches formed by said stitch data, and wherein said third means is operated to decide said minimum rate of speed on the basis of said table.

10. The embroidering sewing machine as defined in claim 8, wherein said third means is operated to decide a lower minimum rate of speed when a length of a stitch is relatively greater.

11. The embroidering sewing machine as defined in claim 9, wherein said third means is operated to set a minimum rate of speed specified in said table with respect to an initial stitch data having no N number of the following stitch data.

12. The embroidering sewing machine as defined in claim 7, further comprising a sixth means operated to set said N number of stitch data in each of said blocks.

13. An embroidering sewing machine having means for vertically reciprocating a needle and means for moving an object to be stitched relative to said needle thereby to form stitches on said object, said sewing machine comprising:

a) memory means having stitch data stored therein for deciding the positions of said object relative to said needle in accordance with an embroidery pattern to be stitched;

b) a first means for vertically reciprocating said needle at a specified speed;

c) a second means for defining a plurality of blocks each of which comprises N number of stitch data arranged in the order of the stitches formed by said stitch data with each data being successively elected as an initial stitch data in each block;

d) a third means for deciding a minimum rate of speed of the vertical movement of said needle in correspondence to a distance between the stitches formed by said stitch data constituting each of said blocks;

e) a fourth means for comparing the present minimum rate of speed with the minimum rate of speed which has been set at the immediately preceding stitch data and discriminating if there is a difference with respect to time between said two rates of speed, in case the difference is more than a predetermined value, said fourth means being operated to amend said present minimum rate of speed into an amended minimum rate of speed and setting said present minimum rate of speed as the vertical movement of said needle in correspondence to the last stitch date of the block, and in case the difference is not more than the predetermined value with respect to time, said fourth means being operated to set said present minimum rate of speed as the speed of the vertical reciprocating movement of said needle in correspondence to said initial stitch data of the block; and f) a fifth means for vertically reciprocating said needle at said set rate of speed.

* * * * *